US012291681B2

(12) United States Patent
Gounder et al.

(10) Patent No.: US 12,291,681 B2
(45) Date of Patent: May 6, 2025

(54) METHOD OF PRODUCING HYDROCARBON MIXTURES RICH IN AROMATICS

(71) Applicants: Institute of Technology Petronas SDN. BHD.; Transwater Tenaga SDN. BHD., Shah Alam (MY)

(72) Inventors: Ramasamy Marappa Gounder, Perak (MY); Anita Ramli, Perak (MY); Kim Heong Khor, Selangor (MY)

(73) Assignees: INSTITUTE OF TECHNOLOGY PETRONAS SDN. BHD., Perak (MY); TRANSWATER TENAGA SDN. BHD., Selangor (MY)

( * ) Notice: Subject to any disclaimer, the term of this patent is extended or adjusted under 35 U.S.C. 154(b) by 26 days.

(21) Appl. No.: 18/036,874

(22) PCT Filed: Oct. 28, 2021

(86) PCT No.: PCT/MY2021/050095
§ 371 (c)(1),
(2) Date: May 12, 2023

(87) PCT Pub. No.: WO2022/103251
PCT Pub. Date: May 19, 2022

(65) Prior Publication Data

US 2023/0416618 A1 Dec. 28, 2023

(30) Foreign Application Priority Data

Nov. 12, 2020 (MY) ..... PI2020005930

(51) Int. Cl.
*C10G 59/02* (2006.01)

(52) U.S. Cl.
CPC ..... *C10G 59/02* (2013.01); *C10G 2300/305* (2013.01); *C10G 2300/4006* (2013.01); *C10G 2300/4081* (2013.01); *C10G 2400/30* (2013.01)

(58) Field of Classification Search
None
See application file for complete search history.

(56) References Cited

U.S. PATENT DOCUMENTS 2,335,531 A * 11/1943 Praeger ..... C10G 35/04 208/82
9,670,113 B2 * 6/2017 Iyer ..... C07C 2/84
(Continued)

FOREIGN PATENT DOCUMENTS

EP 0002171 A1 * 5/1978

*Primary Examiner* — Tam M Nguyen
(74) *Attorney, Agent, or Firm* — Alston & Bird LLP

(57) ABSTRACT

A method of producing hydrocarbon mixtures rich in aromatics from naphtha feedstock (100 or 100*a*) comprising the steps of feeding naphtha feedstock (100 or 100*a*) and liquified petroleum gases (101*a* and 101*b*) into reactor effluent/feed heat exchanger (200 or 300) to yield mixture (102 or 102*a*), channeling the mixture (102 or 102*a*) into at least one and at most three reactors via integrated heaters to produce hydrocarbon mixtures rich in aromatics, channeling effluent into reactor effluent/feed heat exchanger (200 or 300) before it is transferred to cooling tank (203), cooling the effluent in cooling tank (203), introducing cooled effluent (107) into first stage separator (204) to obtain light gases, transferring remaining liquid into second stage separator (206) and separating remaining liquid to yield LPG (101*b*) and directing effluent into stabilizer (207) to separate off gas, LPG (101*c*) and reformate, wherein the reformate is the hydrocarbon mixtures rich in aromatics.

12 Claims, 4 Drawing Sheets

(56) References Cited

U.S. PATENT DOCUMENTS

| | | | | |
|---|---|---|---|---|
| 9,969,660 | B2 * | 5/2018 | Iyer | C10G 57/02 |
| 10,377,682 | B2 * | 8/2019 | Rafique | B01J 4/004 |
| 2021/0395083 | A1 * | 12/2021 | Harale | B01J 8/0207 |
| 2024/0124786 | A1 * | 4/2024 | Alkilde | C10G 2/334 |

* cited by examiner

METHOD OF PRODUCING HYDROCARBON MIXTURES RICH IN AROMATICS

FIELD OF THE INVENTION

The present invention relates to a method of producing hydrocarbon mixtures rich in aromatics from naphtha feedstock, in particular the method is designed to obtain hydrocarbon mixtures rich in aromatics having research octane number of at least 102 while keeping the capital and operating expenditures low.

BACKGROUND OF THE INVENTION

Presently, the hydrocarbon mixtures rich in aromatics are prepared by converting naphtha feedstock over solid catalysts in adiabatic reactors using hydrogen rich gases as carrier gas (or also referred as co-feed) to the reactors (or also referred as reaction tank). These hydrogen rich gases are by-products of the reaction of which were recycled to be used as carrier gas as an initiative to carry heat to the reactors for sustaining endothermic reactions in converting naphtha feedstock and also to slow down the rate of catalyst deactivation. However, the latter needed a large gas compressor to circulate carrier gas back to the reactors and also needed to produce steam for driving the large compressor.

The conventional method of producing the hydrocarbon mixtures rich in aromatics transfers only part of the heat energy released by the process heaters to the reactors and releases surplus heat in the convection section of the heaters, which was practically resulted as a waste and often referred as waste heat. In order to reduce as much waste as possible, the waste heat was channeled to produce steam for driving the large gas compressors (as described above) for recycling the hydrogen rich gases back into reactors. Unfortunately, the above highlighted initiatives resulted in high investment costs and high operating expenditures.

Still further, the method of producing the hydrocarbon mixtures rich in aromatics are catalyst dependent process. The catalyst is used in the reactors as a medium for reaction to generate the desired product. After some time, the catalyst will be deactivated by the coke formation, which would require regeneration before it is ready to be reused. The regeneration step is carried out on-site either continuously or intermittently such that the catalyst is reusable.

The above may be achieved while the reactors running (also referred as continuous production process) by continuously circulating catalysts between the reactors and an integrated catalyst regenerator. This method sustains high catalyst activities but it incurs high investment costs. This approach is applicable to a semi-continuous production as well, wherein the production process will be stopped momentarily for 2 to 3 weeks, possibly once in several months such as but not limited to once in six months to regenerate the deactivated catalysts in the reactors in-situ. Once the catalysts regenerated, the process continues for another cycle of six months.

These approaches however work optimally whenever appropriate quality of feedstocks are fed into the reactors. If the quality of feedstock drops, the percentage of yield and its research octane number (RON) drop as well. Higher yield and RON can be achieved by continuously regenerating the catalyst but the higher investment cost makes this option not always attractive due to consideration of return on investment (ROI). Hence, the industry is struggling to obtain the hydrocarbon mixtures rich in aromatics having research octane number (RON) of at least 100 while ensuring the capital and operating expenditures are kept low.

Having said the above, an approach is clearly required by the industry to develop a method of producing hydrocarbon mixtures rich in aromatics that is able to overcome the above mentioned technical issues such that it is able to reduce the capital and operating expenditures as well as to obtain hydrocarbon mixtures rich in aromatics having research octane number (RON) of at least 100.

SUMMARY OF THE INVENTION

The present invention relates to a method of producing hydrocarbon mixtures rich in aromatics from naphtha feedstock (100 or 100*a*) comprising the steps of:

i. feeding naphtha feedstock (100 or 100*a*) and liquified petroleum gases, LPG (101*a* and 101*b*) into reactor effluent/feed heat exchanger (200 or 300) to yield a mixture (102 or 102*a*), wherein the naphtha feedstock (100 or 100*a*) and the LPG (101*a* and 101*b*) have an initial temperature of below 100° C. prior to the step (i) and wherein the mixture (102 or 102*a*) achieves a temperature in the range between 350° C. to 500° C. in the reactor effluent/feed heat exchanger (200 or 300);

ii. channeling the mixture (102 or 102*a*) obtained from the step (i) into at least one reactor via integrated heater to produce hydrocarbon mixtures rich in aromatics, wherein the heater raises the temperature of the mixture (102 or 102*a*) to at most 550° C.;

iii. channeling effluent obtained from the step (ii) into the reactor effluent/feed heat exchanger (200 or 300) for reducing its temperature to below 100° C. before it is transferred to a cooling tank (203), wherein the temperature of the effluent is reduced by transferring the heat to the incoming mixture (102 or 102*a*);

iv. cooling the effluent obtained from the reactor effluent/feed heat exchanger (200 or 300) in the step (iii) in the cooling tank (203) to a temperature below 40° C.;

v. introducing cooled effluent obtained from the step (iv) into first stage separator (204) to obtain light gases, wherein the separation is carried out at a temperature below 40° C. and at a pressure ranging between 5 to 30 bars;

vi. transferring the remaining liquid obtained from the first stage separator (204) in the step (v) into second stage separator (206) and separating the remaining liquid in the second stage separator (206) to yield LPG (101*b*), wherein the separation is carried out at temperatures and pressures above the temperatures and the pressures in the first stage separator (204); and vii. directing the effluent obtained from the second stage separator (206) in the step (vi) into stabilizer (207) to separate off gas, LPG (101*c*) and reformate, wherein the reformate is the hydrocarbon mixtures rich in aromatics, wherein the mixture (102 or 102*a*) achieves a temperature in the range between 350° C. to 500° C. in the reactor effluent/feed heat exchanger (200 or 300) in the step (i) by way of heat exchange from the effluents to the mixture (102 or 102*a*) in the reactor effluent/feed heat exchanger (200 or 300), wherein the heaters generate waste heat that is recycled into air preheaters (208) to raise the temperature of air from around 30° C. to at least 100° C. by way of heat exchange from the waste heat to the incoming air that eventually used along with fuel as heating source to run the heaters and wherein the LPG (101*b*) is recycled back into the reactor effluent/feed heat exchanger (200 or 300) without using a compressor.

Additional aspects, features and advantages of the invention will become apparent to those skilled in the art upon consideration of the following detailed description of preferred embodiments of the invention in conjunction with the drawings listed below.

BRIEF DESCRIPTION OF THE ACCOMPANYING DRAWINGS

The present invention will be fully understood from the detailed description given herein below and the accompanying drawings which are given by way of illustration only, and thus are not limitative of the present invention, wherein:

DETAILED DESCRIPTION OF THE INVENTION

Figure 1:
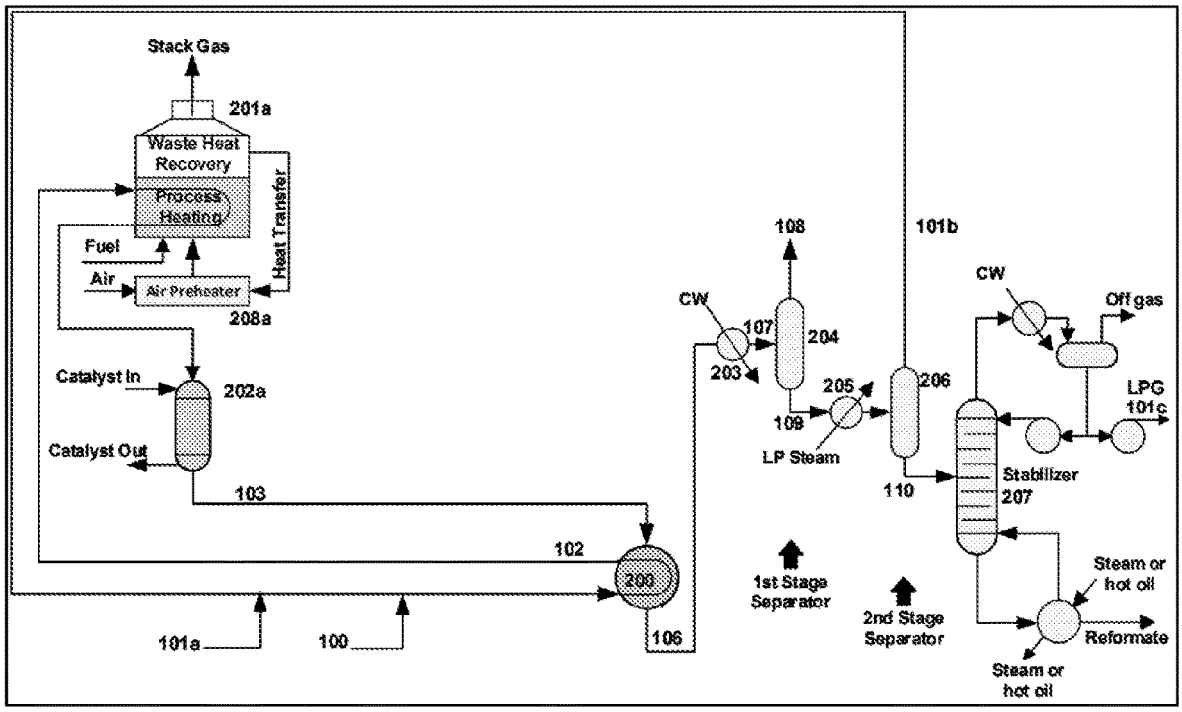
FIG. 1 is a conceptual representation of the method of the present invention of producing hydrocarbon mixtures rich in aromatics from naphtha feedstock using one reactor.
Figure 2:
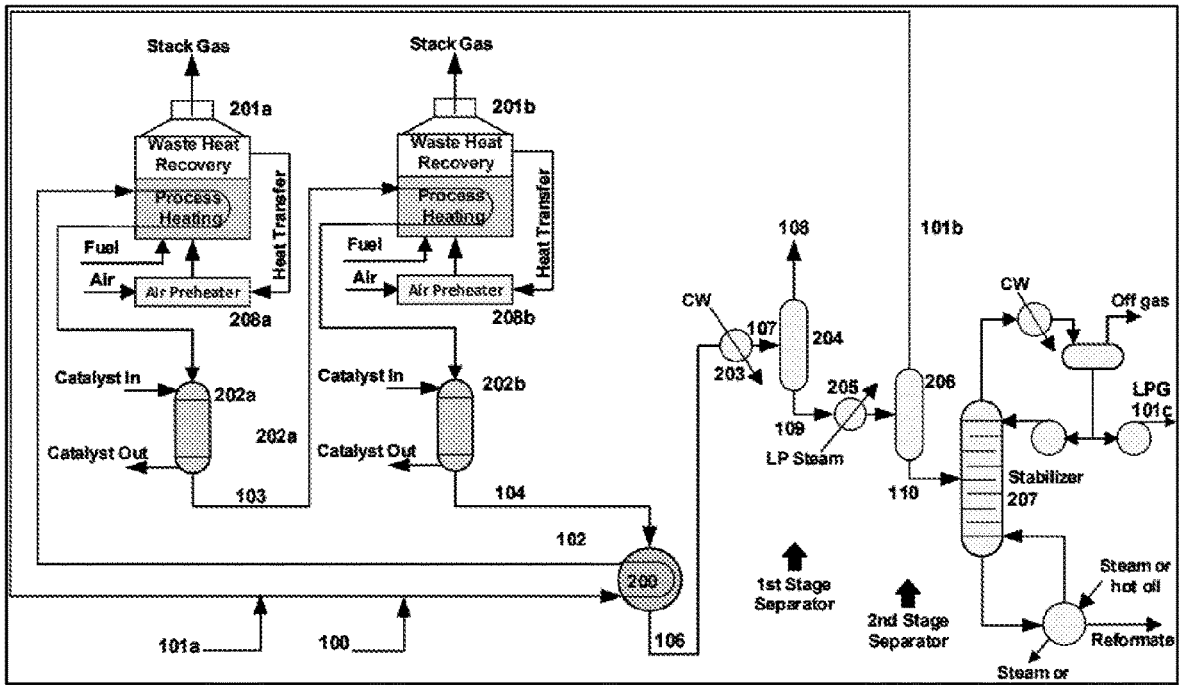
FIG. 2 is a conceptual representation of the method of the present invention of producing hydrocarbon mixtures rich in aromatics from naphtha feedstock using two reactors.
Figure 3:
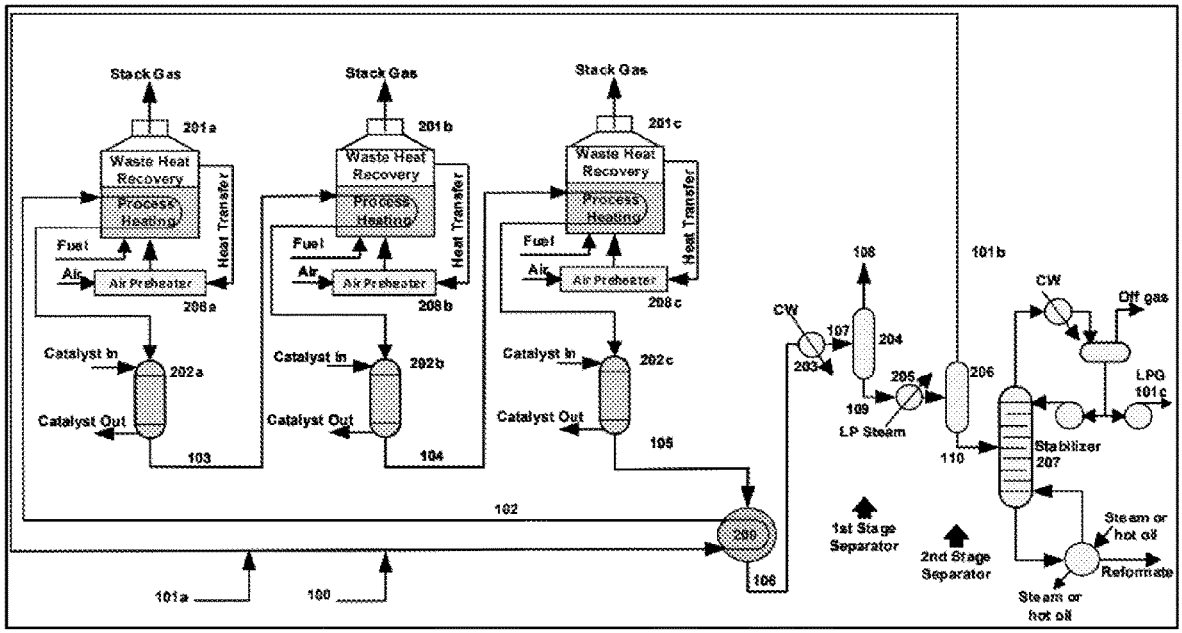
FIG. 3 is a conceptual representation of the method of the present invention of producing hydrocarbon mixtures rich in aromatics from naphtha feedstock using three reactors.

Detailed description of preferred embodiments of the present invention is disclosed herein. It should be understood, however, that the embodiments are merely exemplary of the present invention, which may be embodied in various forms. Therefore, the details disclosed herein are not to be interpreted as limiting, but merely as the basis for the claims and for teaching one skilled in the art of the invention. The numerical data or ranges used in the specification are not to be construed as limiting. The following detailed description of the preferred embodiments will now be described in accordance with the attached drawings.

The present invention relates to a method of producing hydrocarbon mixtures rich in aromatics from naphtha feedstock, in particular the method is designed to obtain hydrocarbon mixtures rich in aromatics having research octane number of at least 102 while keeping the capital and operating expenditures (CAPEX and OPEX) low. Primarily, the method of the present invention is developed to save both CAPEX and OPEX, which is achieved by way of making changes to several aspects of the current technology that will be discussed hereinafter under several embodiments to show its advantages.

This approach is also an initiative towards 5R concept, whereby the method of the present invention is carried out to avoid wasting of potentially useful materials. In particular, it reduces CAPEX and energy usage. Further, pollution levels are reduced since it burns less fuels. Simply, this approach is advantageous in view of both economically and environmentally.

Referring to the accompanying drawings, FIGS. 1, 2, 3 and 4 are conceptual representation of the method of the present invention of producing hydrocarbon mixtures rich in aromatics from naphtha feedstock, wherein the naphtha feedstock may be selected from the group consisting of $C_6$ hydrocarbons, $C_7$ hydrocarbons, $C_6$ to $C_7$ hydrocarbons, $C_6$ to $C_{11}$ hydrocarbons, $C_7$ to $C_{11}$ hydrocarbons and $C_8$ to $C_{11}$ hydrocarbons which is obtainable at a boiling temperature ranging between 65° C. to 85° C., 85° C. to 105° C., 65° C. to 105° C., 65° C. to 175° C., 85° C. to 175° C., and 105° C. to 175° C. respectively.

In general, the method of producing hydrocarbon mixtures rich in aromatics from naphtha feedstock of the present invention comprises a first step of feeding a naphtha feedstock (100 or 100*a*) and liquified petroleum gases, LPG (101*a* and 101*b*) into reactor effluent/feed heat exchanger (200 or 300) to yield a mixture (102 or 102*a*), wherein the LPG is a mixture of propane and butane and wherein the LPG is in vapour form. Prior to this step, the mixture (102 or 102*a*) have an initial temperature of below 100° C. In this step, the temperature of the mixture (102 or 102*a*) is raised to a range between 350° C. to 500° C. The latter is achieved by transferring heat from the effluents (103 or 104 or 105 or 103*a* or 104*a* or 105*a*) to the mixture (102 or 102*a*) in the reactor effluent/feed heat exchanger (200 or 300).

The LPG (101*a* and 101*b*) acts as a carrier gas for carrying heat from the reactor effluent/feed heat exchanger (200 or 300) and the heaters (201*a*, 201*b* and 201*c*) to the reactors (202*a*, 202*b* and 202*c*), as well as, functions as a dilution medium for the naphtha feedstock (100 or 100*a*). Initially, the LPG (101*a*) is fed from an external source manually into the reactor effluent/feed heat exchanger (200 or 300) until the LPG (101*b*) is produced in the second stage separator (206).

Once the LPG (101*b*) is produced in the second stage separator (206), the LPG (101*b*) is recycled and used as carrier gas. Hence, the LPG (101*a*) that is fed manually into the reactor effluent/feed heat exchanger (200 or 300) can be instantaneously terminated. Simply, the external supply of LPG (101*a*) is just momentarily and isn't required throughout the process.

The first step of the present invention helps to reduce the number of reactors (202*a*, 202*b* and 202*c*) to at least one and at most three reactors for producing hydrocarbon mixtures rich in aromatics having research octane number, RON of at least 100 as compared to the conventional method of using hydrogen rich gas as the carrier gas which requires at least three and at most five reactors. This is due to the higher heat carrying capacity of LPG (101*a*, 101*b* and 101*c*) as compared to the hydrogen rich gas, which is at least more than 3 times.

Further, the first step of the present invention reduces the CAPEX and the OPEX of recycling carrier gas, allowing a larger quantity of carrier gas to be recycled for carrying heat from the reactor effluent/feed heat exchanger (200 or 300) and the heaters (201*a*, 201*b* and 201*c*) to the reactors (202*a*, 202*b* and 202*c*), contributing to reducing the number of reactors required for producing hydrocarbon mixtures rich in aromatics.

For instance, one reactor requires carrier gas flow of more than 8 moles of LPG (101*a* and 101*b*) to 1 mole of naphtha feedstock (100 or 100*a*). Whereas two reactors require carrier gas flow in the range between 4 to 8 moles of LPG (101*a* and 101*b*) to 1 mole of naphtha feedstock (100 or 100*a*). Lastly, three reactors require carrier gas flow of less than 4 moles of LPG (101*a* and 101*b*) to 1 mole of naphtha feedstock (100 or 100*a*).

For the purpose of the present invention, the LPG (101*a* and 101*b*) is not consumed in the reaction and it does not serve the purpose as a reactant. Thereafter, second step of the present invention is carried out by way of channeling the mixture obtained from the first step of the present invention into at least one reactor (202*a*) via integrated heater (201*a*) or at least two reactors (202*a* and 202*b*) via integrated heaters (201*a* and 201*b*) or at most three reactors (202*a*, 202*b* and 202*c*) via integrated heaters (201*a*, 201*b* and 201*c*) to raise the temperature of the mixture (102, 103 and 104 or 102*a*, 103*a* and 104*a*) to at most 550° C. This is the desired/optimum condition for the naphtha feedstock (100 or 100*a*) in the mixture (102, 103 and 104 or 102*a*, 103*a* and 104*a*) to react in the reactors (202*a*, 202*b* and 202*c*).

The second step of the present invention occurs in the reactors (202*a*, 202*b* and 202*c*), whereby the mixture (102, 103 and 104 or 102*a*, 103*a* and 104*a*) from the heaters (201*a*, 201*b* and 201*c*) are fed onto catalysts placed in the reactors (202*a*, 202*b* and 202*c*) to initiate the aromatization process and to produce hydrocarbon mixtures rich in aromatics. The reactors (202*a*, 202*b* and 202*c*) are equipped with facilities for allowing catalyst inventory such that the catalysts can be withdrawn from the reactors (202*a*, 202*b* and 202*c*) and replaced with the same type or different type of catalysts without even opening the reactors (202*a*, 202*b* and 202*c*).

The latter is very important for the present invention since it contributes to the method of the present invention in a way that the entire catalyst inventory could be easily changed one or more times without shutting the process plant before the end of an operating cycle that could last for at least 3 years. This second step of the present invention allows the process plant to change catalysts whenever it is necessary, for instance (1) if a more advance catalyst or a cheaper catalyst is available in the market or (2) if an existing catalyst inventory became unsuitable due to a structural change in feedstock quality which makes it more attractive to use another catalyst.

This second step of the present invention also allows deactivated catalysts to be replaced with active catalysts while the deactivated catalysts are sent to an off-site location for regeneration. The latter is different from the conventional approach of which practices on-site catalysts regeneration since there is less restriction in designing an off-site catalyst regenerator as compared to an on-site catalyst regenerator, for which the regeneration process can be more optimally controlled to minimize deterioration of catalysts during regeneration.

Moreover, the off-site catalysts regeneration offers the advantage of (1) using an equipment that allows better control over the regeneration process, as well as, (2) other catalyst reconditioning options. For example, the latter allows re-impregnation of metal into the catalysts to adjust the metal function of catalysts. In comparison, the conventional continuous production process regenerates catalysts on-site and operates with only one type of catalyst over the entire operating cycle and would need to shut down the process plant for unloading the entire catalyst inventory in order to change to a new batch of catalysts.

With reference to the structural change in feedstock quality, the quality of naphtha feedstock (100 or 100*a*) can be either one with high paraffin content (referred as paraffinic feedstock) or one with high cyclo-paraffin content (referred as naphthenic feedstock). Having said the above, the present invention allows the process plant to switch the catalyst inventory when there is a structural change in the feedstock quality, particularly from paraffinic feedstock to naphthenic feedstock or vice versa.

Separately, the catalysts could either be more effective for converting paraffins into aromatics or more effective for converting cyclo-paraffins into aromatics. Conventionally, the process plant has to operate with catalysts that are optimized for the average feedstock quality since it is not practical to shut down the process plant for changing the catalyst inventory.

Simply, when the quality of naphtha feedstock (100 or 100*a*) switches, say from paraffinic feedstock to naphthenic feedstock or vice versa, the catalysts can be replaced with the ones appropriate to the quality of naphtha feedstock such that it would produce higher yield and/or higher RON. The replacement of catalysts can be carried out without the necessity of discontinuing the production process. Consequently, the product loss can be minimized, and hence, the ROI can be maximized.

The catalysts are but not limited to zeolite-based catalysts, provided that the catalysts are able to operate with LPG (101*a* and 101*b*) being the carrier gas. The catalysts are operated in the reactors (202*a*, 202*b* and 202*c*) as below:

i. the catalysts are added into the reactors (202*a*, 202*b* and 202*c*) using but not limited to catalyst transfer pipes from the top of the reactors (202*a*, 202*b* and 202*c*); and
ii. the catalysts are withdrawn from the bottom of the reactors (202*a*, 202*b* and 202*c*).

Perhaps, the reactors (202*a*, 202*b* and 202*c*) comprise:

i. catalysts loading and unloading transfer hoppers for ensuring the safe operation of transferring catalysts into and out of the reactors (202*a*, 202*b* and 202*c*); and
ii. catalyst loading and unloading lock hoppers for ensuring the safe operation in segregating hydrocarbons from air.

During the transition from the inlet of first reactor (202*a*) to the second reactor (202*b*) and/or from the inlet of the second reactor (202*b*) to the third reactor (202*c*), temperature of the effluents (103 and 104 or 103*a* and 104*a*) will drop below the optimum level required for sustaining product conversion due to the endothermic reactions of producing aromatics. Thus, the effluents (103 and 104 or 103*a* and 104*a*) from the earlier reactor will be re-heated in the integrated heaters (201*b* and 201*c*) before it is transferred into the second reactor (202*b*) or third reactor (202*c*) for further processing to yield the hydrocarbon mixtures rich in aromatics.

Subsequently, third step of the present invention is carried out by way of channeling the effluents (103 or 103*a*) obtained from the first reactor (202*a*) or (104 or 104*a*) obtained from the second reactor (202*b*) or (105 or 105*a*) obtained from the third reactor (202*c*) into the reactor effluent/feed heat exchanger (200 or 300) for reducing its temperature from above 300° C. to below 100° C. by transferring heat to the mixture (102 or 102*a*) before it is transferred to a cooling tank (203).

Fourth step of the present invention occurs in the cooling tank (203), whereby in the cooling tank (203) the temperature of the effluent (106 or 106*a*) from the reactor effluent/feed heat exchanger (200 or 300) will be reduced by using but not limited to either air and/or water to a temperature below 40° C. Fifth step of the present invention is carried out by way of introducing the cooled effluent (107) into the first stage separator (204) where light gases (108) such as but not limited to hydrogen, methane and ethane are separated from the cooled effluent (107).

Sixth step of the present invention is carried out by way of transferring remaining liquid (109) from the first stage separator (204) using a pump into second stage separator (206) via evaporator (205) in order to boil off part of the LPG either in the evaporator (205) or in the second stage separator (206). The process in the second stage separator (206) is carried out at higher pressure and higher temperature than the process in the first stage separator (204) of which operates below 40° C. and at operating pressure that ranges from 5 to 30 bar. The LPG (101*b*) obtained from the second stage separator (206) is recycled back into the reactor effluent/feed heat exchanger (200 or 300) as carrier gas (as discussed above) without using a compressor.

The benefit of using LPG (101*a* and 101*b*) instead of light gases (108) from the first stage separator (204) as carrier gas are as follows:

i. it eliminates the need to invest in a gas compressor, which is required in order to recycle the light gases (108) back into the reactor effluent/feed heat exchanger (200 or 300), reduces CAPEX and OPEX of the present invention;

ii. it eliminates the need to recover waste heat from the heaters (201*a*, 201*b* and 201*c*) for producing steam to drive the gas compressor, reduces fuel consumption and hence reduces OPEX;

iii. it eliminates the need to use heaters with wall burners in order to reduce the lengths of transfer pipes between the heaters and the reactors for reducing CAPEX and OPEX of the recycle gas compressor. Instead, the present invention uses heaters with bottom fired burners which allows for the installation of combustion air preheaters (208*a*, 208*b* and 208*c*) to utilized waste heat from the convection section of the heaters (201*a*, 201*b* and 201*c*) to reduce fuel consumption for saving OPEX. To elaborate, the waste heat is used in the air preheaters to raise the temperature of air from around 30° C. to at least 100° C. by way of heat exchange from the waste heat to the incoming air, wherein the air is used along with fuel as heating source to run the heaters (201*a*, 201*b* and 201*c*). The preheated air carries large energy that the consumption of fuel is lessen in the heaters (201*a*, 201*b* and 201*c*);

iv. it eliminates additional number of reactors for processing the naphtha feedstocks (100 or 100*a*) due to the higher specific heat capacity of LPG (101*a* and 101*b*) as compared to light gases (108) and the low CAPEX and the low OPEX of recycling LPG as carrier gas which allows more carrier gas to be recycled for carrying heat from the reactor effluent/feed heat exchanger (200 or 300) and the heaters (201*a*, 201*b* and 201*c*) to the reactors (202*a*, 202*b* and 202*c*). Simply, the conventional process plants require at least three and at most five reactors to process naphtha feedstock while the present invention is able to process the naphtha feedstocks with at least one and at most three reactors; and v. it eliminates the need to recycle LPG (101*c*) from the stabilizer (207) that would incur higher CAPEX and OPEX since it would require a larger stabilizer and consume more valuable energy sources for vaporizing and condensing the LPG (101*c*) before it could be recycled by pump to the reactor effluent/feed heat exchanger (200 or 300) as carrier gas.

Finally, the effluent (110) from the second stage separator (206) is transferred by pump to the stabilizer (207) to separate off gas, LPG (101*c*) and reformate. The reformate is the hydrocarbon mixtures rich in aromatics, wherein the hydrocarbon mixtures rich in aromatics are having research octane number (RON) of at least 100, preferably RON of at least 102. The hydrocarbon mixtures rich in aromatics are aromatics having carbon number chain between $C_6$ to $C_{11}$, preferably aromatics having carbon number chain between $C_6$ to $C_{10}$, still preferably aromatics having carbon number chain between $C_7$ to $C_{10}$.

Figure 4:
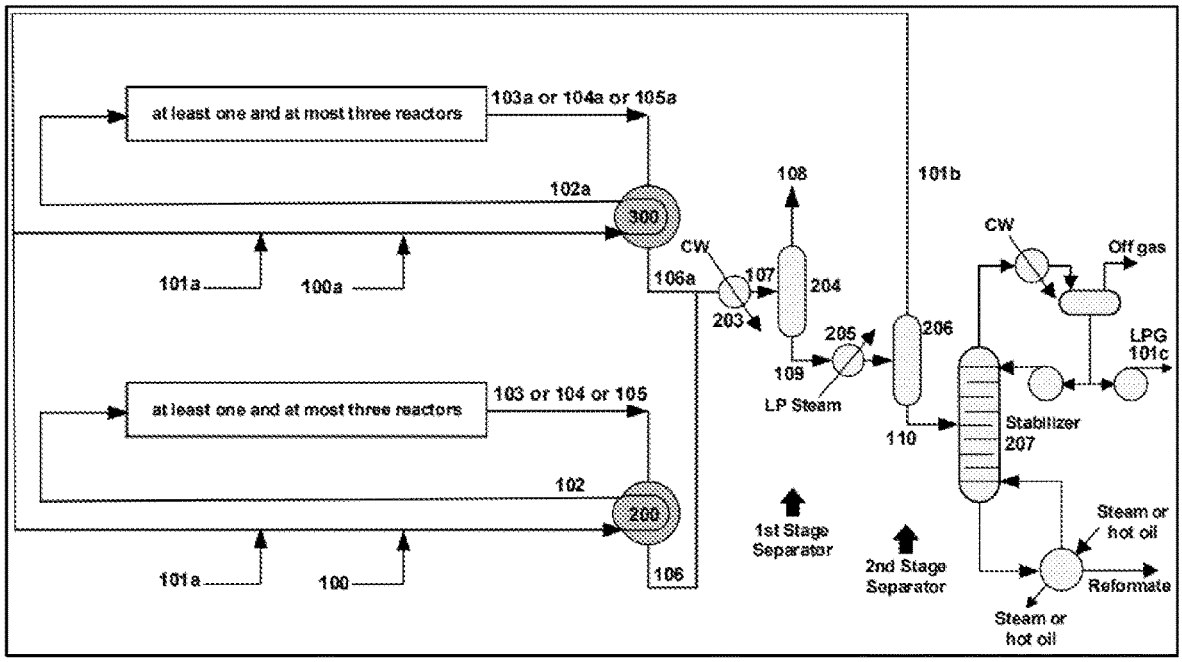
FIG. 4 is a conceptual representation of the method of the present invention of producing hydrocarbon mixtures rich in aromatics from naphtha feedstock using at least one and at most three reactors with the reactors arranged in parallel.

Referring to the accompanying drawings, FIG. 4 is a conceptual representation of the method of the present invention of producing hydrocarbon mixtures rich in aromatics from naphtha feedstock with the reactors (202*a*, 202*b* and 202*c*) operating with different sets of catalysts and/or operating conditions as compared to the reactors arranged in parallel for processing two different quality of naphtha feedstocks for producing products that could be blended together.

The cooling tank (203), the first stage separator (204), the evaporator (205), the second stage separator (206) and the stabilizer (207) could be shared by two sets of reactors for processing the two different quality of naphtha feedstocks, which reduces CAPEX and OPEX as compared to processing the two types of naphtha feedstocks in two separate process plants. For example, $C_8$ to $C_{11}$ hydrocarbons could be processed in the reactors (202*a*, 202*b* and 202*c*) and $C_7$ hydrocarbons could be processed in the reactors arranged in parallel.

The following example is constructed to illustrate the present invention in a non-limiting sense.

Example 1

Producing Hydrocarbon Mixtures Rich in Aromatics from Naphtha Feedstock Using One Reactor A method of producing hydrocarbon mixtures rich in aromatics from naphtha feedstock (100 or 100*a*) comprising the steps of:

i. feeding naphtha feedstock (100 or 100*a*) and liquified petroleum gases, LPG (101*a* and 101*b*) into reactor effluent/feed heat exchanger (200 or 300) to yield a mixture (102 or 102*a*); wherein the naphtha feedstock (100 or 100*a*) and the LPG (101*a* and 101*b*) have an initial temperature of below 100° C. prior to the step (i) and wherein the mixture (102 or 102*a*) achieves a temperature in the range between 350° C. to 500° C. in the reactor effluent/feed heat exchanger (200 or 300);

ii. channeling the mixture (102 or 102*a*) obtained from the step (i) into first heater (201*a*) to raise the temperature of the mixture (102 or 102*a*) to at most 550° C.;

iii. directing the mixture (102 or 102*a*) obtained from the step (ii) into reactor (202*a*) to initiate and complete aromatization process and to produce hydrocarbon mixtures rich in aromatics;

iv. channeling effluent (103 or 103*a*) obtained from the step (iii) into the reactor effluent/feed heat exchanger (200 or 300) for reducing its temperature to below 100° C. before it is transferred to a cooling tank (203), wherein the temperature of the effluent (103 or 103*a*) is reduced by transferring the heat to the incoming mixture (102 or 102*a*);

v. cooling the effluent (106 or 106*a*) obtained from the reactor effluent/feed heat exchanger (200 or 300) in the step (iv) in the cooling tank (203) by using either air and/or water to a temperature below 40° C.;

vi. introducing cooled effluent (107) obtained from the step (v) into first stage separator (204) where light gases (108) such as but not limited to hydrogen, methane and ethane are separated from the cooled effluent (107), wherein the separation is carried out at a temperature below 40° C. and at a pressure ranging between 5 to 30 bars;

vii. transferring the remaining liquid (109) obtained from the first stage separator (204) in the step (vi) into second stage separator (206) via evaporator (205), wherein the remaining liquid (109) includes LPG and wherein the LPG is partly boiled off in the evaporator (205);

viii. separating the remaining liquid (109) in the second stage separator (206) to yield LPG (101*b*), wherein the separation is carried out at temperatures and pressures above the temperatures and the pressures in the first stage separator (204); and ix. directing the effluent (110) obtained from the second stage separator (206) in the step (viii) into stabilizer (207) to separate off gas, LPG (101*c*) and reformate, wherein the reformate is the hydrocarbon mixtures rich in aromatics and wherein the hydrocarbon mixtures rich in aromatics are having research octane number (RON) of at least 100, preferably RON of at least 102, wherein the mixture (102 or 102*a*) achieves a temperature in the range between 350° C. to 500° C. in the reactor effluent/feed heat exchanger (200 or 300) in the step (i) by way of heat exchange from the effluents (103 or 103*a*) to the mixture (102 or 102*a*) in the reactor effluent/feed heat exchanger (200 or 300), wherein the heater (201*a*) generate waste heat that is recycled into air preheaters (208*a*) to raise the temperature of air from around 30° C. to at least 100° C. by way of heat exchange from the waste heat to the incoming air that eventually used along with fuel as heating source to run the heaters (201*a*) and wherein the LPG (101*b*) is recycled back into the reactor effluent/feed heat exchanger (200 or 300) without using a compressor.

Example 2

Producing Hydrocarbon Mixtures Rich in Aromatics from Naphtha Feedstock Using Two Reactors A method of producing hydrocarbon mixtures rich in aromatics from naphtha feedstock (100 or 100*a*) comprising the steps of:

i. feeding naphtha feedstock (100 or 100*a*) and liquified petroleum gases, LPG (101*a* and 101*b*) into reactor effluent/feed heat exchanger (200 or 300) to yield a mixture (102 or 102*a*); wherein the naphtha feedstock (100 or 100*a*) and the LPG (101*a* and 101*b*) have an initial temperature of below 100° C. prior to the step (i) and wherein the mixture (102 or 102*a*) achieves a temperature in the range between 350° C. to 500° C. in the reactor effluent/feed heat exchanger (200 or 300);

ii. channeling the mixture (102 or 102*a*) obtained from the step (i) into first heater (201*a*) to raise the temperature of the mixture (102 or 102*a*) to at most 550° C.;

iii. directing the mixture (102 or 102*a*) obtained from the step (ii) into first reactor (202*a*) to initiate aromatization process and to produce hydrocarbon mixtures rich in aromatics;

iv. channeling effluent (103 or 103*a*) obtained from the step (iii) into second heater (201*b*) to raise the temperature of the effluent (103 or 103*a*) to at most 550° C.;

v. directing the effluent (103 or 103*a*) obtained from the step (iv) into second reactor (202*b*) to complete aromatization process and to produce hydrocarbon mixtures rich in aromatics;

vi. channeling effluent (104 or 104*a*) obtained from the step (v) into the reactor effluent/feed heat exchanger (200 or 300) for reducing its temperature to below 100° C. before it is transferred to a cooling tank (203), wherein the temperature of the effluent (104 or 104*a*) is reduced by transferring the heat to the incoming mixture (102 or 102*a*);

vii. cooling the effluent (106 or 106*a*) obtained from the reactor effluent/feed heat exchanger (200 or 300) in the step (vi) in the cooling tank (203) by using either air and/or water to a temperature below 40° C.;

viii. introducing cooled effluent (107) obtained from the step (vii) into first stage separator (204) where light gases (108) such as but not limited to hydrogen, methane and ethane are separated from the cooled effluent (107), wherein the separation is carried out at a temperature below 40° C. and at a pressure ranging between 5 to 30 bars;

ix. transferring the remaining liquid (109) obtained from the first stage separator (204) in the step (viii) into second stage separator (206) via evaporator (205), wherein the remaining liquid (109) includes LPG and wherein the LPG is partly boiled off in the evaporator (205);

x. separating the remaining liquid (109) in the second stage separator (206) to yield LPG (101*b*), wherein the separation is carried out at temperatures and pressures above the temperatures and the pressures in the first stage separator (204); and xi. directing the effluent (110) obtained from the second stage separator (206) in the step (x) into stabilizer (207) to separate off gas, LPG (101*c*) and reformate, wherein the reformate is the hydrocarbon mixtures rich in aromatics and wherein the hydrocarbon mixtures rich in aromatics are having research octane number (RON) of at least 100, preferably RON of at least 102, wherein the mixture (102 or 102*a*) achieves a temperature in the range between 350° C. to 500° C. in the reactor effluent/feed heat exchanger (200 or 300) in the step (i) by way of heat exchange from the effluents (104 or 104*a*) to the mixture (102 or 102*a*) in the reactor effluent/feed heat exchanger (200 or 300), wherein the heaters (201*a* and 201*b*) generate waste heat that is recycled into air preheaters (208*a* and 208*b*) to raise the temperature of air from around 30° C. to at least 100° C. by way of heat exchange from the waste heat to the incoming air that eventually used along with fuel as heating source to run the heaters (201*a* and 201*b*) and wherein the LPG (101*b*) is recycled back into the reactor effluent/feed heat exchanger (200 or 300) without using a compressor.

Example 3

Producing Hydrocarbon Mixtures Rich in Aromatics from Naphtha Feedstock Using Three Reactors A method of producing hydrocarbon mixtures rich in aromatics from naphtha feedstock (100 or 100*a*) comprising the steps of:

i. feeding naphtha feedstock (100 or 100*a*) and liquified petroleum gases, LPG (101*a* and 101*b*) into reactor effluent/feed heat exchanger (200 or 300) to yield a mixture (102 or 102*a*); wherein the naphtha feedstock (100 or 100*a*) and the LPG (101*a* and 101*b*) have an initial temperature of below 100° C. prior to the step (i) and wherein the mixture (102 or 102*a*) achieves a temperature in the range between 350° C. to 500° C. in the reactor effluent/feed heat exchanger (200 or 300);

ii. channeling the mixture (102 or 102*a*) obtained from the step (i) into first heater (201*a*) to raise the temperature of the mixture (102 or 102*a*) to at most 550° C.;

iii. directing the mixture (102 or 102*a*) obtained from the step (ii) into first reactor (202*a*) to initiate aromatization process and to produce hydrocarbon mixtures rich in aromatics;

iv. channeling effluent (103 or 103*a*) obtained from the step (iii) into second heater (201*b*) to raise the temperature of the effluent (103 or 103*a*) to at most 550° C.;

v. directing the effluent (103 or 103*a*) obtained from the step (iv) into second reactor (202*b*) to continue aromatization process and to produce hydrocarbon mixtures rich in aromatics;

vi. channeling effluent (104 or 104*a*) obtained from the step (v) into third heater (201*c*) to raise the temperature of the effluent (104 or 104*a*) to at most 550° C.;

vii. directing the effluent (104 or 104*a*) obtained from the step (vi) into third reactor (202*c*) to complete aromatization process and to produce hydrocarbon mixtures rich in aromatics;

viii. channeling effluent (105 or 105*a*) obtained from the step (vii) into the reactor effluent/feed heat exchanger (200 or 300) for reducing its temperature to below 100° C. before it is transferred to a cooling tank (203), wherein the temperature of the effluent (105 or 105*a*) is reduced by transferring the heat to the incoming mixture (102 or 102*a*);

ix. cooling the effluent (106 or 106*a*) obtained from the reactor effluent/feed heat exchanger (200 or 300) in the step (viii) in the cooling tank (203) by using either air and/or water to a temperature below 40° C.;

x. introducing cooled effluent (107) obtained from the step (ix) into first stage separator (204) where light gases (108) such as but not limited to hydrogen, methane and ethane are separated from the cooled effluent (107), wherein the separation is carried out at a temperature below 40° C. and at a pressure ranging between 5 to 30 bars;

xi. transferring the remaining liquid (109) obtained from the first stage separator (204) in the step (x) into second stage separator (206) via evaporator (205), wherein the remaining liquid (109) includes LPG and wherein the LPG is partly boiled off in the evaporator (205);

xii. separating the remaining liquid (109) in the second stage separator (206) to yield LPG (101*b*), wherein the separation is carried out at temperatures and pressures above the temperatures and the pressures in the first stage separator (204); and xiii. directing the effluent (110) obtained from the second stage separator (206) in the step (xii) into stabilizer (207) to separate off gas, LPG (101*c*) and reformate, wherein the reformate is the hydrocarbon mixtures rich in aromatics and wherein the hydrocarbon mixtures rich in aromatics are having research octane number (RON) of at least 100, preferably RON of at least 102, wherein the mixture (102 or 102*a*) achieves a temperature in the range between 350° C. to 500° C. in the reactor effluent/feed heat exchanger (200 or 300) in the step (i) by way of heat exchange from the effluents (105 or 105*a*) to the mixture (102 or 102*a*) in the reactor effluent/feed heat exchanger (200 or 300), wherein the heaters (201*a*, 201*b* and 201*c*) generate waste heat that is recycled into air preheaters (208*a*, 208*b* and 208*c*) to raise the temperature of air from around 30° C. to at least 100° C. by way of heat exchange from the waste heat to the incoming air that eventually used along with fuel as heating source to run the heaters (201*a*, 201*b* and 201*c*) and wherein the LPG (101*b*) is recycled back into the reactor effluent/feed heat exchanger (200 or 300) without using a compressor.

Comparison Between Conventional System and System of the Present Invention

Table 1 shows comparison of conventional system and system of the present invention in terms of the numbers of reactors with integrated heaters that could be reduced by recycling LPG as carrier gas that contains mainly propane and butane instead of recycling hydrogen rich gas as carrier gas.

| | | $C_p$/mole of naphtha ($JK^{-1}mole^{-1}$) | | | | | |
|---|---|---|---|---|---|---|---|
| | | Conventional system (recycled hydrogen rich gas) | System of the present invention | | | | |
| | $C_p$/mole ($JK^{-1}mole^{-1}$) | | Recycle propane | | Recycle butane | | |
| Mole ratio of recycle gas versus naphtha feed | | 4X | 8X | 4X | 8X | 4X | 8X |
| $C_p$ of $H_2$ rich gas | 42.0 | 168.0 | 336.0 | — | — | — | — |
| $C_p$ of propane | 175.0 | — | — | 700.0 | 1400.0 | — | — |
| $C_p$ of butane | 227.0 | — | — | — | — | 908.0 | 1816.0 |
| $C_p$ of naphtha | 405.0 | 405.0 | 405.0 | 405.0 | 405.0 | 405.0 | 405.0 |
| $C_p$ of combined feed per mole of naphtha | | 573.0 | 741.0 | 1105.0 | 1805.0 | 1313.0 | 2221.0 |
| $C_p$ of combined feed versus the BASE case | | BASE | 1.3X | 1.9X | 3.2X | 2.3X | 3.9X |
| Reactor numbers versus conventional system | | | | | | | |
| 3 reactors BASE case | | 3 | 2.3 | 1.6 | 0.9 | 1.3 | 0.8 |
| 4 reactors BASE case | | 4 | 3.1 | 2.1 | 1.3 | 1.7 | 1.0 |
| 5 reactors BASE case | | 5 | 3.8 | 2.6 | 1.6 | 2.2 | 1.3 |
| Number of reactors required per case | | 3-5 | 3-4 | 2-3 | 1-2 | 2-3 | 1-2 |
| Number of reactors required per process | | 3-5 | | 1-3 | | 1-3 | |

Remarks: $C_p$ represents specific heat capacity

Based on the Table 1, it is evident that:

1. For the BASE case with a typical 4× recycle gas/naphtha mole ratio which require 3 reactors with integrated heaters, the present invention would only require 2 reactors with integrated heaters at 4× recycle gas/naphtha mole ratio and would only require 1 reactor with integrated heater at 8× recycle gas/naphtha mole ratio;
2. For the BASE case with a typical 4× recycle gas/naphtha mole ratio which require 4 reactors with integrated heaters, the present invention would only require 2 reactors with integrated heaters at between 4× to 8× recycle gas/naphtha mole ratio.
3. For the BASE case with a typical 4× recycle gas/naphtha mole ratio which require 5 reactors with integrated heaters, the present invention would only require 3 reactors with integrated heaters at 4× recycle gas/naphtha mole ratio and would only require 2 reactors with integrated heaters at 8× recycle gas/naphtha mole ratio.

Simply, heat energy which is required for sustaining the endothermic reactions of producing hydrocarbon mixtures rich in aromatics are carried from the reactor effluent/feed heat exchanger and the process heaters to the adiabatic reactors by the naphtha feedstock as well as by the carrier gas. The present invention uses LPG (which contains propane and butane) as carrier gas while the conventional system uses hydrogen rich gas as carrier gas.

Due to the higher heat carrying capacity of propane and butane, the present invention could sustain more endothermic reactions in the reactors before the temperature of the combined feed drops below the required level for sustaining the endothermic reactions. Hence, the present invention reduces the number of times that the reactor effluents would need to be reheated for completing the endothermic reactions of producing hydrocarbon mixtures rich in aromatics.

As a result, the present invention only requires at least one reactor with integrated heater and at most three reactors with integrated heaters for completing the endothermic reactions of producing hydrocarbon mixtures rich in aromatics. In comparison, the conventional system requires at least three reactors with integrated heaters and at most five reactors with integrated heaters for completing the endothermic reactions of producing hydrocarbon mixtures rich in aromatics due to the low heat carrying capacity of hydrogen rich gas.

As a whole, the method of producing the hydrocarbon mixtures rich in aromatics of the present invention is able to optimize capital and operating expenditures by keeping them low, as well as, is able to obtain the hydrocarbon mixtures rich in aromatics having research octane number (RON) of at least 100.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises", "comprising", "including", and "having" are inclusive and therefore specify the presence of stated features, integers, steps, operations, elements, and/or components, but do not preclude the presence or addition of one or more other features, integers, steps, operations, elements, components, and/or groups therefrom.

The method steps, processes, and operations described herein are not to be construed as necessarily requiring their performance in the particular order discussed or illustrated, unless specifically identified as an order of performance. It is also to be understood that additional or alternative steps may be employed. The use of the expression "at least" or "at least one" suggests the use of one or more elements, as the use may be in one of the embodiments to achieve one or more of the desired objects or results.

The invention claimed is:

1. A method of producing hydrocarbon mixtures rich in aromatics from naphtha feedstock (100 or 100*a*) comprising the steps of:

i. feeding naphtha feedstock (100 or 100*a*) and liquified petroleum gases, LPG (101*a* and 101*b*) into reactor effluent/feed heat exchanger (200 or 300) to yield a mixture (102 or 102*a*), wherein the naphtha feedstock (100 or 100*a*) and the LPG (101*a* and 101*b*) have an initial temperature of below 100° C. prior to the step (i) and wherein the mixture (102 or 102*a*) achieves a temperature in the range between 350° C. to 500° C. in the reactor effluent/feed heat exchanger (200 or 300);

ii. channeling the mixture (102 or 102*a*) obtained from the step (i) into at least one reactor via integrated heater to produce hydrocarbon mixtures rich in aromatics, wherein the integrated heater raises the temperature of the mixture (102 or 102*a*) to at most 550° C.;

iii. channeling effluent obtained from the step (ii) into the reactor effluent/feed heat exchanger (200 or 300) for reducing its temperature to below 100° C. before it is transferred to a cooling tank (203), wherein the temperature of the effluent is reduced by transferring the heat to the incoming mixture (102 or 102*a*);

iv. cooling the effluent obtained from the reactor effluent/feed heat exchanger (200 or 300) in the step (iii) in the cooling tank (203) to a temperature below 40° C.;

v. introducing cooled effluent obtained from the step (iv) into first stage separator (204) to obtain light gases, wherein the separation is carried out at a temperature below 40° C. and at a pressure ranging between 5 to 30 bars;

vi. transferring the remaining liquid obtained from the first stage separator (204) in the step (v) into second stage separator (206) and separating the remaining liquid in the second stage separator (206) to yield LPG (101*b*), wherein the separation is carried out at temperatures and pressures above the temperatures and the pressures in the first stage separator (204); and vii. directing the effluent obtained from the second stage separator (206) in the step (vi) into stabilizer (207) to separate off gas, LPG (101*c*) and reformate, wherein the reformate is the hydrocarbon mixtures rich in aromatics, wherein the mixture (102 or 102*a*) achieves a temperature in the range between 350° C. to 500° C. in the reactor effluent/feed heat exchanger (200 or 300) in the step (i) by way of heat exchange from the effluents obtained from step (ii) to the mixture (102 or 102*a*) in the reactor effluent/feed heat exchanger (200 or 300), wherein the integrated heater generate waste heat that is recycled into air preheater (208*a*) to raise the temperature of air from around 30° C. to at least 100° C. by way of heat exchange from the waste heat to the incoming air that is eventually used along with fuel as heating source to run the integrated heater and wherein the LPG (101*b*) is recycled back into the reactor effluent/feed heat exchanger (200 or 300) without using a compressor.

2. The method of producing hydrocarbon mixtures rich in aromatics as claimed in claim 1, wherein the naphtha feedstock (100 or 100*a*) is selected from the group consisting of $C_6$ hydrocarbons, $C_7$ hydrocarbons, $C_6$ to $C_7$ hydrocarbons, $C_6$ to $C_{11}$ hydrocarbons, $C_7$ to $C_{11}$ hydrocarbons and $C_8$ to $C_{11}$ hydrocarbons.

3. The method of producing hydrocarbon mixtures rich in aromatics as claimed in claim 1, wherein the naphtha feedstock (100 or 100*a*) requires one reactor (202*a*) and one integrated heater (201*a*) to produce hydrocarbon mixtures rich in aromatics.

4. The method of producing hydrocarbon mixtures rich in aromatics as claimed in claim 1, wherein the naphtha feedstock (100 or 100*a*) requires two reactors (202*a* and 202*b*) and two integrated heaters (201*a* and 201*b*) to produce hydrocarbon mixtures rich in aromatics.

5. The method of producing hydrocarbon mixtures rich in aromatics as claimed in claim 1, wherein the naphtha feedstock (100 or 100*a*) requires three reactors (202*a*, 202*b* and 202*c*) and three integrated heaters (201*a*, 201*b* and 201*c*) to produce hydrocarbon mixtures rich in aromatics.

6. The method of producing hydrocarbon mixtures rich in aromatics as claimed in claim 1, wherein the cooling in the cooling tank (203) is carried out using either air and/or water.

7. The method of producing hydrocarbon mixtures rich in aromatics as claimed in claim 1, wherein the light gases are hydrogen, methane and ethane.

8. The method of producing hydrocarbon mixtures rich in aromatics as claimed in claim 1, wherein the hydrocarbon mixtures rich in aromatics have a research octane number of at least 100.

9. The method of producing hydrocarbon mixtures rich in aromatics as claimed in claim 1, wherein the hydrocarbon mixtures rich in aromatics have a research octane number of at least 102.

10. A method of producing hydrocarbon mixtures rich in aromatics from naphtha feedstock (100 or 100*a*) comprising the steps of:

i. feeding naphtha feedstock (100 or 100*a*) and liquified petroleum gases, LPG (101*a* and 101*b*) into reactor effluent/feed heat exchanger (200 or 300) to yield a mixture (102 or 102*a*); wherein the naphtha feedstock (100 or 100*a*) and the LPG (101*a* and 101*b*) have an initial temperature of below 100° C. prior to the step (i) and wherein the mixture (102 or 102*a*) achieves a temperature in the range between 350° C. to 500° C. in the reactor effluent/feed heat exchanger (200 or 300);

ii. channeling the mixture (102 or 102*a*) obtained from the step (i) into heater (201*a*) to raise the temperature of the mixture (102 or 102*a*) to at most 550° C.;

iii. directing the mixture (102 or 102*a*) obtained from the step (ii) into reactor (202*a*) to initiate and complete aromatization process and to produce hydrocarbon mixtures rich in aromatics;

iv. channeling effluent (103 or 103*a*) obtained from the step (iii) into the reactor effluent/feed heat exchanger (200 or 300) for reducing its temperature to below 100° C. before it is transferred to a cooling tank (203), wherein the temperature of the effluent (103 or 103*a*) is reduced by transferring the heat to the incoming mixture (102 or 102*a*);

v. cooling the effluent (106 or 106*a*) obtained from the reactor effluent/feed heat exchanger (200 or 300) in the step (iv) in the cooling tank (203) by using either air and/or water to a temperature below 40° C.;

vi. introducing cooled effluent (107) obtained from the step (v) into first stage separator (204) wherein hydrogen, methane and ethan are separated from the cooled effluent (107), wherein the separation is carried out at a temperature below 40° C. and at a pressure ranging between 5 to 30 bars;

vii. transferring the remaining liquid (109) obtained from the first stage separator (204) in the step (vi) into second stage separator (206) via evaporator (205), wherein the remaining liquid (109) includes LPG and wherein the LPG is partly boiled off in the evaporator (205);

viii. separating the remaining liquid (109) in the second stage separator (206) to yield LPG (101*b*), wherein the separation is carried out at temperatures and pressures above the temperatures and the pressures in the first stage separator (204); and ix. directing the effluent (110) obtained from the second stage separator (206) in the step (viii) into stabilizer (207) to separate off gas, LPG (101*c*) and reformate, wherein the reformate is the hydrocarbon mixtures rich in aromatics and wherein the hydrocarbon mixtures rich in aromatics have a research (RON) of at least 100, wherein the mixture (102 or 102*a*) achieves a temperature in the range between 350° C. to 500° C. in the reactor effluent/feed heat exchanger (200 or 300) in the step (i) by way of heat exchange from the effluents (103 or 103*a*) to the mixture (102 or 102*a*) in the reactor effluent/feed heat exchanger (200 or 300), wherein the heater (201*a*) generate waste heat that is recycled into air preheater (208*a*) to raise the temperature of air from around 30° C. to at least 100° C. by way of heat exchange from the waste heat to the incoming air that is eventually used along with fuel as heating source to run the heater (201*a*) and wherein the LPG (101*b*) is recycled back into the reactor effluent/feed heat exchanger (200 or 300) without using a compressor.

11. A method of producing hydrocarbon mixtures rich in aromatics from naphtha feedstock (100 or 100*a*) comprising the steps of:

i. feeding naphtha feedstock (100 or 100*a*) and liquified petroleum gases, LPG (101*a* and 101*b*) into reactor effluent/feed heat exchanger (200 or 300) to yield a mixture (102 or 102*a*); wherein the naphtha feedstock (100 or 100*a*) and the LPG (101*a* and 101*b*) have an initial temperature of below 100° C. prior to the step (i) and wherein the mixture (102 or 102*a*) achieves a temperature in the range between 350° C. to 500° C. in the reactor effluent/feed heat exchanger (200 or 300);

ii. channeling the mixture (102 or 102*a*) obtained from the step (i) into first heater (201*a*) to raise the temperature of the mixture (102 or 102*a*) to at most 550° C.;

iii directing the mixture (102 or 102*a*) obtained from the step (ii) into first reactor (202*a*) to initiate aromatization process and to produce hydrocarbon mixtures rich in aromatics;

iv. channeling effluent (103 or 103*a*) obtained from the step (iii) into second heater (201*b*) to raise the temperature of the effluent (103 or 103*a*) to at most 550° C.;

v. directing the effluent (103 or 103*a*) obtained from the step (iv) into second reactor (202*b*) to complete aromatization process and to produce hydrocarbon mixtures rich in aromatics;

vi. channeling effluent (104 or 104*a*) obtained from the step (v) into the reactor effluent/feed heat exchanger (200 or 300) for reducing its temperature to below 100° C. before it is transferred to a cooling tank (203), wherein the temperature of the effluent (104 or 104*a*) is reduced by transferring the heat to the incoming mixture (102 or 102*a*);

vii. cooling the effluent (106 or 106*a*) obtained from the reactor effluent/feed heat exchanger (200 or 300) in the step (vi) in the cooling tank (203) by using either air and/or water to a temperature below 40° C.;

viii. introducing cooled effluent (107) obtained from the step (vii) into first stage separator (204) wherein hydrogen, methane and ethane. are separated from the cooled effluent (107), wherein the separation is carried out at a temperature below 40° C. and at a pressure ranging between 5 to 30 bars;

ix. transferring the remaining liquid (109) obtained from the first stage separator (204) in the step (viii) into second stage separator (206) via evaporator (205), wherein the remaining liquid (109) includes LPG and wherein the LPG is partly boiled off in the evaporator (205);

x. separating the remaining liquid (109) in the second stage separator (206) to yield LPG (101*b*), wherein the separation is carried out at temperatures and pressures above the temperatures and the pressures in the first stage separator (204); and xi directing the effluent (110) obtained from the second stage separator (206) in the step (x) into stabilizer (207) to separate off gas, LPG (101*c*) and reformate, wherein the reformate is the hydrocarbon mixtures rich in aromatics and wherein the hydrocarbon mixtures rich in aromatics have a research octane number (RON) of at least 100, preferably RON of at least 102, wherein the mixture (102 or 102*a*) achieves a temperature in the range between 350° C. to 500° C. in the reactor effluent/feed heat exchanger (200 or 300) in the step (i) by way of heat exchange from the effluents (104 or 104*a*) to the mixture (102 or 102*a*) in the reactor effluent/feed heat exchanger (200 or 300), wherein the heaters (201*a* and 201*b*) generate waste heat that is recycled into air preheaters (208*a* and 208*b*) to raise the temperature of air from around 30° C. to at least 100° C. by way of heat exchange from the waste heat to the incoming air that is eventually used along with fuel as heating source to run the heaters (201*a* and 201*b*) and wherein the LPG (101*b*) is recycled back into the reactor effluent/feed heat exchanger (200 or 300) without using a compressor.

12. A method of producing hydrocarbon mixtures rich in aromatics from naphtha feedstock (100 or 100*a*) comprising the steps of:

i. feeding naphtha feedstock (100 or 100*a*) and liquified petroleum gases, LPG (101*a* and 101*b*) into reactor effluent/feed heat exchanger (200 or 300) to yield a mixture (102 or 102*a*); wherein the naphtha feedstock (100 or 100*a*) and the LPG (101*a* and 101*b*) have an initial temperature of below 100° C. prior to the step (i) and wherein the mixture (102 or 102*a*) achieves a temperature in the range between 350° C. to 500° C. in the reactor effluent/feed heat exchanger (200 or 300);

ii. channeling the mixture (102 or 102*a*) obtained from the step (i) into first heater (201*a*) to raise the temperature of the mixture (102 or 102*a*) to at most 550° C.;

iii. directing the mixture (102 or 102*a*) obtained from the step (ii) into first reactor (202*a*) to initiate aromatization process and to produce hydrocarbon mixtures rich in aromatics;

iv. channeling effluent (103 or 103*a*) obtained from the step (iii) into second heater (201*b*) to raise the temperature of the effluent (103 or 103*a*) to at most 550° C.;

v. directing the effluent (103 or 103*a*) obtained from the step (iv) into second reactor (202*b*) to continue aromatization process and to produce hydrocarbon mixtures rich in aromatics;

vi. channeling effluent (104 or 104*a*) obtained from the step (v) into third heater (201*c*) to raise the temperature of the effluent (104 or 104*a*) to at most 550° C.;

vii. directing the effluent (104 or 104*a*) obtained from the step (vi) into third reactor (202*c*) to complete aromatization process and to produce hydrocarbon mixtures rich in aromatics;

viii. channeling effluent (105 or 105*a*) obtained from the step (vii) into the reactor effluent/feed heat exchanger (200 or 300) for reducing its temperature to below 100° C. before it is transferred to a cooling tank (203), wherein the temperature of the effluent (105 or 105*a*) is reduced by transferring the heat to the incoming mixture (102 or 102*a*);

ix. cooling the effluent (106 or 106*a*) obtained from the reactor effluent/feed heat exchanger (200 or 300) in the step (viii) in the cooling tank (203) by using either air and/or water to a temperature below 40° C.;

x introducing cooled effluent (107) obtained from the step (ix) into first stage separator (204) wherein hydrogen, methane and ethane are separated from the cooled effluent (107), wherein the separation is carried out at a temperature below 40° C. and at a pressure ranging between 5 to 30 bars;

xi. transferring the remaining liquid (109) obtained from the first stage separator (204) in the step (x) into second stage separator (206) via evaporator (205), wherein the remaining liquid (109) includes LPG and wherein the LPG is partly boiled off in the evaporator (205);

xii. separating the remaining liquid (109) in the second stage separator (206) to yield LPG (101*b*), wherein the separation is carried out at temperatures and pressures above the temperatures and the pressures in the first stage separator (204); and xiii. directing the effluent (110) obtained from the second stage separator (206) in the step (xii) into stabilizer (207) to separate off gas, LPG (101*c*) and reformate, wherein the reformate is the hydrocarbon mixtures rich in aromatics and wherein the hydrocarbon mixtures rich in aromatics have a research octane (RON) of at least 100, wherein the mixture (102 or 102*a*) achieves a temperature in the range between 350° C. to 500° C. in the reactor effluent/feed heat exchanger (200 or 300) in the step (i) by way of heat exchange from the effluents (105 or 105*a*) to the mixture (102 or 102*a*) in the reactor effluent/feed heat exchanger (200 or 300), wherein the heaters (201*a*, 201*b* and 201*c*) generate waste heat that is recycled into air preheaters (208*a*, 208*b* and 208*c*) to raise the temperature of air from around 30° C. to at least 100° C. by way of heat exchange from the waste heat to the incoming air that eventually used along with fuel as heating source to run the heaters (201*a*, 201*b* and 201*c*) and wherein the LPG (101*b*) is recycled back into the reactor effluent/feed heat exchanger (200 or 300) without using a compressor.

* * * * *